US006139387A

United States Patent [19]

Kimura et al.

[11] Patent Number: 6,139,387

[45] Date of Patent: Oct. 31, 2000

[54] METHOD FOR MANUFACTURING A COLOR CATHODE RAY TUBE

[75] Inventors: Masamichi Kimura, Takatsuki; Tsutomu Utsumi, Kyoto; Takashi Kinoshita, Takatsuki, all of Japan

[73] Assignee: Matsushita Electronics Corporation, Takatsuki, Japan

[21] Appl. No.: 09/379,654

[22] Filed: Aug. 24, 1999

[30] Foreign Application Priority Data

Aug. 26, 1998 [JP] Japan ..... 10-240149

[51] Int. Cl.[7] ..... H01J 9/18

[52] U.S. Cl. ..... 445/30

[58] Field of Search ..... 445/30

[56] References Cited

U.S. PATENT DOCUMENTS

| | | | |
|---|---|---|---|
| 4,857,027 | 8/1989 | Makita et al. | 445/37 |
| 5,622,637 | 4/1997 | Taiana | 219/64 |
| 5,681,197 | 10/1997 | Egami et al. | 445/30 |

FOREIGN PATENT DOCUMENTS

| | | |
|---|---|---|
| 62-232832 | 10/1987 | Japan . |
| 64-84540 | 3/1989 | Japan . |
| 04022042 | 1/1992 | Japan . |

OTHER PUBLICATIONS

04022042 A, Patent Abstract of Japan, Jan. 27, 1992, 1 page.

62232832 A, Patent Abstracts of Japan, Oct. 13, 1987, 1 page.

*Primary Examiner*—Kenneth J Ramsey
*Attorney, Agent, or Firm*—Rosenthal & Osha L.L.P.

[57] ABSTRACT

Welding is conducted by rolling a roller electrode of a roller-type resistance welder while contacting an electrode surface of the roller electrode against an outer edge of the mask frame via the shadow mask. This method eliminates the need for complex control, and allows smooth and reliable welding at predetermined positions with a simple configuration. By forming the weld nugget on the side of the edge, a flat portion remains when the shadow mask is torn off the mask frame in case of a failure of the shadow mask. Thus, a second welding with a flat portion of the original height is possible, and the mask frame can be reused with the same precision for the welding position.

5 Claims, 7 Drawing Sheets

METHOD FOR MANUFACTURING A COLOR CATHODE RAY TUBE

BACKGROUND OF THE INVENTION

1. Field of the Invention

The present invention relates to a method for manufacturing a color cathode ray tube, such as is used for a television or a computer display. More particularly, it relates to a method for manufacturing a color cathode ray tube in which a shadow mask is fixed by welding it to a mask frame while applying a tension force to the shadow mask and a compression force to the mask frame.

2. Description of the Prior Art

In recent years, ever flatter color cathode ray tube front panels have brought about ever flatter shadow masks. However, as shadow masks become flatter, they cannot be kept flat only by supporting the main body of the shadow mask with a frame, as in conventional shadow masks. In addition, when the main body of the shadow mask is supported only by a frame, the shadow mask vibrates easily due to vibrations from the outside, which adversely affects the display screen of the color cathode ray tube. Therefare, the shadow mask is stretched and fixed to the frame with a constant tension applied to the shadow mask.

On the other hand, also regarding the doming effect, in which the thermal expansion, caused by the impact of the electron beam on the shadow mask, deforms the shadow mask, flatter shadow masks lead to a larger displacement of the electron beam due to the doming, especially in the vicinity of both ends of the screen. Thus, when stretching and fixing the shadow mask as described above, the largest practical level of tension, close to the elastic limit, is applied to the shadow mask, in order to absorb the thermal expansion due to the impact of the electron beam.

Stretching and fixing the shadow mask like this can prevent vibrations of the shadow mask due to outer vibrations, and misalignments between the relative positions of apertures for passing electron beams in the shadow mask and phosphor dots on a phosphor screen, even when the temperature of the shadow mask rises.

Thusly stretched shadow masks are called "tension-type shadow masks". Among the different kinds of tension-type shadow masks, there is the aperture grille-type shadow mask, in which a plurality of slender members are laid across the mask frame, the slot-type shadow mask, in which a plurality of substantially rectangular apertures for passing electron beams are formed in a flat panel, and the dot-type shadow mask, in which a plurality of round apertures for passing electron beams are formed in a flat panel.

Also, shadow masks can be stretched with a one-dimensional tension system or a two-dimensional tension system. "One-dimensional tension system" refers to systems that apply a tension only to the vertical shadow mask direction (parallel to the short sides of the shadow mask), while "two-dimensional tension system" refers to systems that apply a tension both to the vertical and horizontal direction. The one-dimensional tension system is used for aperture grille-type shadow masks, and both systems are used for slot-type and dot-type shadow masks.

With regard to methods for manufacturing a color cathode ray tube in which a shadow mask fixed by welding it to a mask frame while a tension force is applied to the shadow mask and a compression force is applied to the mask frame, several welding methods have been suggested. Publication of Japanese Unexamined Patent Application (Tokkai) No. Sho 64-84540 discloses a method for welding the central portion in the width direction of the upper side of the mask frame along each side of the mask frame.

Publication of Japanese Unexamined Patent Application (Tokkai) No. Hei 4-22042 discloses a method for laser welding the central portion in the width direction of an upper side of the mask frame along each side of the mask frame. In addition, Publication of Japanese Unexamined Patent Application (Tokkai) No. Sho 62-232832 discloses a method for moving a welding electrode on a support member (i.e. mask frame).

However, these conventional methods for manufacturing a color cathode ray tube lead to the following problems: (1)The mask frame is rectangular, and when a uniform compression force is applied throughout one entire side, the central portions of the sides of the mask frame warp inward, and the upper edge of the frame tilts inward since the cross section of the frame is usually L-shaped. Therefore, welding the upper surface of the frame requires a complex control of moving the position of the welding point according along the flexure curve of the frame. Furthermore, when the upper side of the frame is tilting inward, it is difficult to bring the shadow mask into close contact with the upper side of the frame (the upper surface of the upright portion of the L-shaped portion) for the welding step. (2) Since the distance between the shadow mask and the phosphor screen (q-value) requires strict control, precision of the position of welding surface where the shadow mask is fixed is important. When for some reason a failure of the shadow mask occurs, the defect shadow mask is sometimes torn off for replacement and repair. If the remaining surfaces of weld nuggets are abraded so as to weld the shadow mask on again, the welding surface is lowered by the abraded amount, resulting in a substantial deterioration of the precision for the position of the welding surfaces. Accordingly, the initial q-value cannot be ensured. In other words, a slight failure of the shadow mask can lead to a total failure of the shadow mask structure including the mask frame.

SUMMARY OF THE INVENTION

In order to solve these problems, it is an object of the present invention to provide a method for manufacturing a color cathode ray tube in which, by welding along an edge portion of a mask frame, smooth and reliable welding at predetermined positions without complex control is made possible, thereby cutting costs and enabling the reuse of resources.

In order to achieve these objects, a method for manufacturing a color cathode ray tube comprises welding a shadow mask to a mask frame while (a) applying a compression force to the mask frame in a direction that decreases a distance between at least one pair of opposite sides of the mask frame, and (b) applying a tension force to the shadow mask. The welding is conducted by rolling a roller electrode of a roller-type resistance welder while contacting an electrode surface of the roller electrode against an outer edge of the mask frame via the shadow mask. With this method for manufacturing a color cathode ray tube, smooth and reliable welding at predetermined positions is possible with a simple configuration and without necessitating a complex control for letting the welding position follow the flexure curve during the welding.

In this method, it is preferable that the welding is performed while a rotation axis of the roller electrode is tilted. With this method for manufacturing a color cathode ray tube, the electrode surface of the roller electrode can be contacted easily against the edge of the mask frame via the shadow mask.

It is also preferable that the roller electrode has a conic trapezoidal shape with an inclined electrode surface. With this method for manufacturing a color cathode ray tube, the electrode surface of the roller electrode can be contacted easily against the edge of the mask frame via the shadow mask.

It is preferable that a pressure means presses the roller electrode with a constant pressure against the shadow mask. With this method for manufacturing a color cathode ray tube, the electrode surface of the roller electrode can be contacted against the edge of the mask frame via the shadow mask, even when the edge is shifted away from the roller electrode.

It is preferable that a weld nugget formed by the welding is formed at a side of the edge portion of the upper surface of the mask frame, and a surface on which no nugget is formed remains on a side opposite to the edge portion. With this method for manufacturing a color cathode ray tube, a weld nugget remains only at the outer edge portion of the mask frame if the shadow mask is torn off the mask frame in case of a failure of the shadow mask, so that a flat portion remains when the weld nugget at the edge portion is removed. Thus, a second welding with a flat portion of the original height is possible, and the mask frame can be reused with the same precision for the welding position.

If the weld nugget is formed at a side of the edge portion of the upper surface of the mask frame, it is preferable that the weld nugget is formed within an outer half of a width of the upper surface of the mask frame. With this method for manufacturing a color cathode ray tube, the upper surface of the mask frame has a flat portion that is wide enough to weld at least twice. Therefore, if the shadow mask is torn off after the first welding, it can be welded on again at least once. This means that the mask frame can be reused at least once, so that resources can be reused. If, for example, the width of the weld nugget is ⅓ of the width of the upper edge surface of the mask frame, a flat portion remains for welding the upper surface of the mask frame at least twice, and the mask frame can be reused twice.

It is preferable that the mask frame comprises a frame-shaped mask frame body, and a plate member fixed along a side of the mask frame body such that a height direction of at least one side of the mask frame body is increased, and that the shadow mask is welded to the plate member. With this method for manufacturing a color cathode ray tube, a cheap material with a high expansion coefficient can be used for the mask frame body, and the same material with a lower expansion coefficient such as for the shadow mask can be used for the plate member, which allows a reduction of cost.

It is preferable that tension forces acting in two directions are applied to the shadow mask.

BRIEF DESCRIPTION OF THE DRAWINGS

FIG. 4(*b*) shows a side view of an embodiment using another mask frame in a welding step according to the present invention.

DESCRIPTION OF THE PREFERRED EMBODIMENTS

Figure 1A:
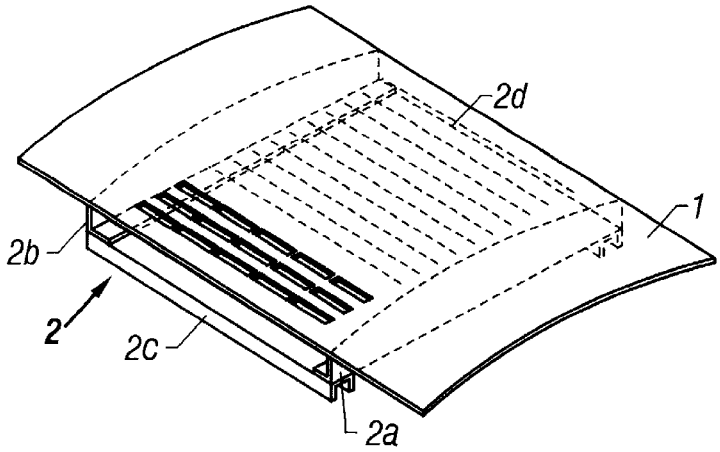
FIGS. 1(*a*)–(*c*) show perspective views illustrating an embodiment of the present invention from a shadow mask setting step to a mask frame stretching step.
Figure 1B:
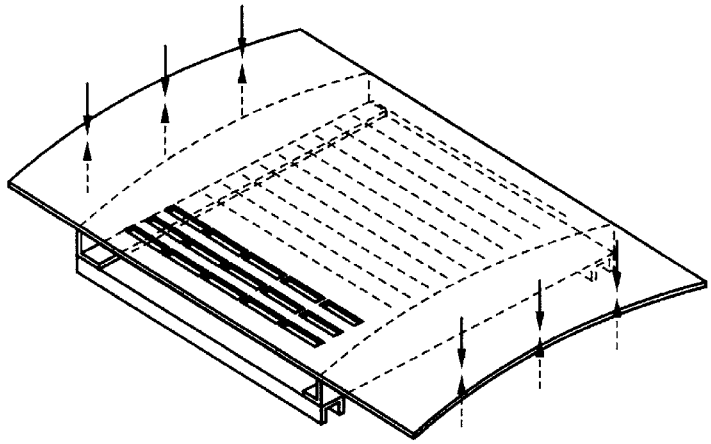
Figure 1C:
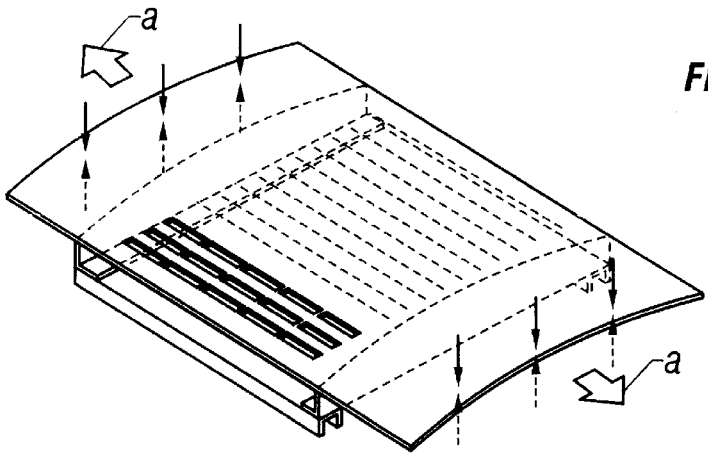
Figure 2A:
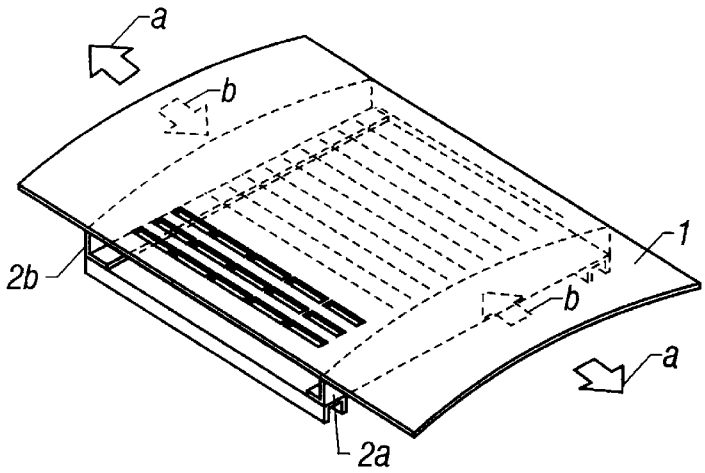
FIGS. 2(*a*)–(*c*) show perspective views illustrating an embodiment of this present invention from a mask frame pressing step to a shadow mask cutting step.
Figure 2B:
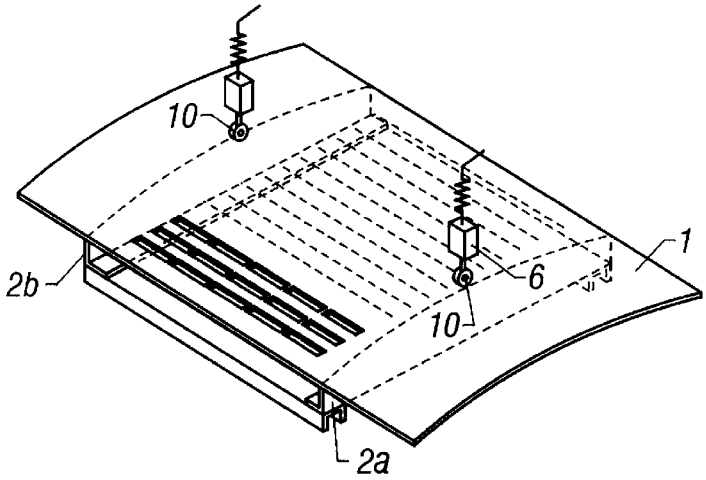
Figure 2C:
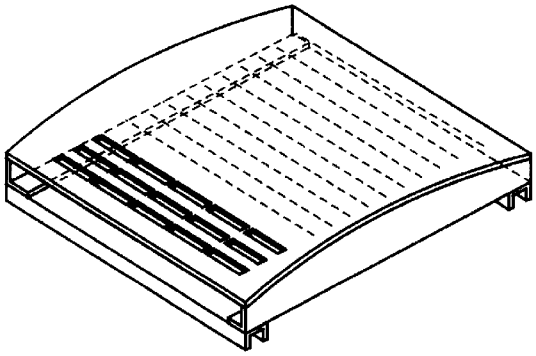
Figure 3:
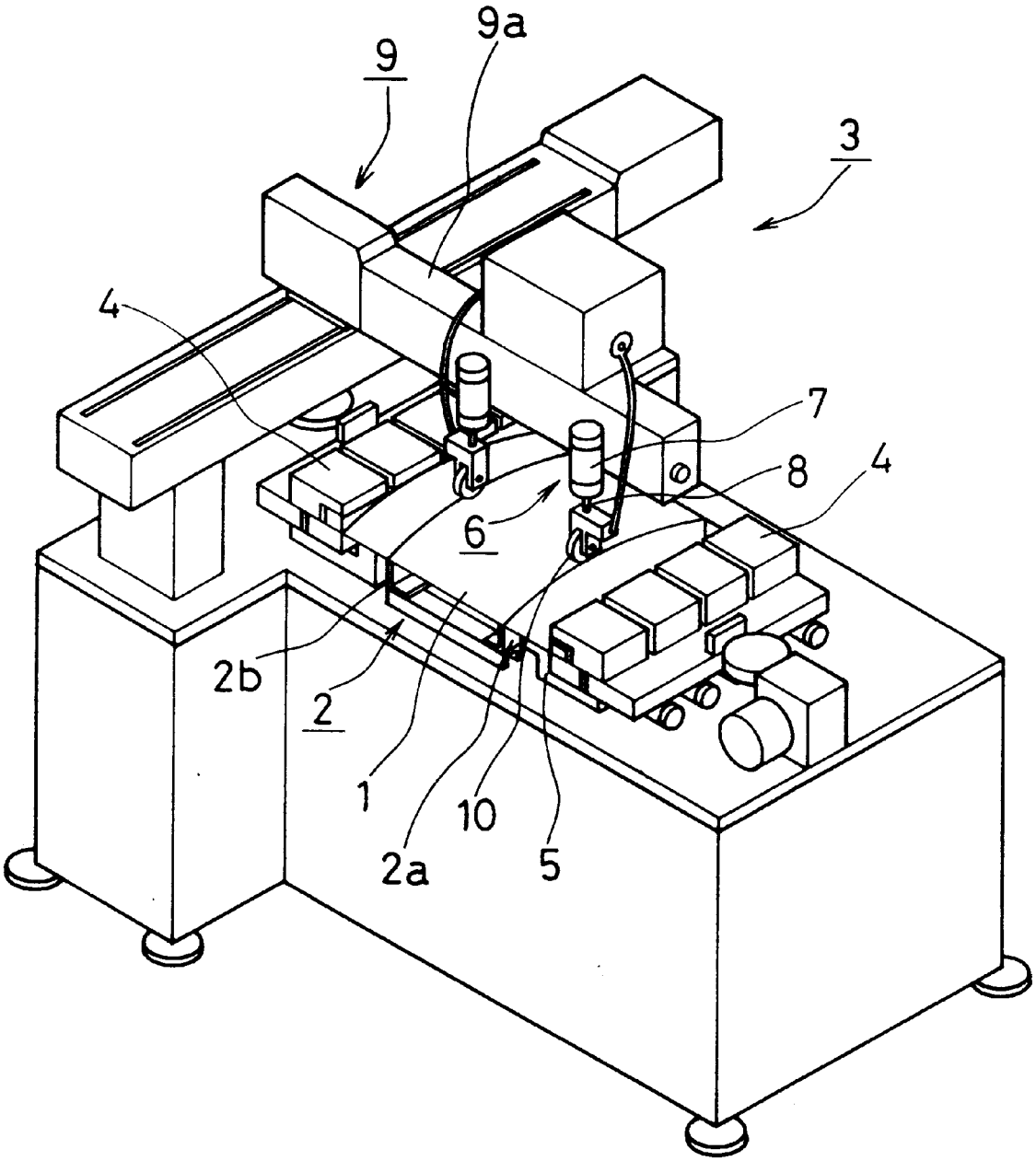
FIG. 3 shows a perspective view illustrating an embodiment of a shadow mask stretching apparatus according to the present invention.

The following is a detailed description of an embodiment of the present invention, with reference to the accompanying drawings. FIG. 1 illustrates an embodiment of the present invention from a shadow mask setting step to a mask frame stretching step, and FIG. 2 illustrates an embodiment of the present invention from a mask frame pressing step to a shadow mask cutting step. FIG. 3 is a perspective view illustrating an embodiment of a shadow mask stretching apparatus which can perform a series of steps from the shadow mask setting step to the welding step. FIG. 3 illustrates how the machine performs a welding step.

The following is a description of a sequence of manufacturing steps, referring to FIGS. 1–7. FIG. 1(*a*) illustrates a shadow mask setting step. A rectangular mask frame 2 is made of upper and lower long frame supports 2*a* and 2*b*, having an L-shaped cross section and facing each other, attached to right and left short frame supports 2*c* and 2*d*. In this step, a shadow mask 1 is aligned with the mask frame 2. This alignment is conducted with a mask frame alignment device (not shown in FIG. 3), which is arranged below the shadow mask 1.

FIG. 1(*b*) illustrates a shadow mask chucking step. In this step, both edge portions of the shadow mask 1 are clamped by a shadow mask chucking device 4 of the shadow mask stretching apparatus 3 shown in FIG. 3. FIG. 1(*c*) illustrates a shadow mask stretching step. In this step, the shadow mask 1 clamped by the shadow mask chucking device 4 is stretched in arrow direction "a".

FIG. 2(*a*) illustrates a mask frame pressing step. In this step, a compression force (in the arrow direction "b") is applied to the long frame supports 2*a* and 2*b* of the mask frame 2. This compression force is applied with a mask frame pressing device 5 in the shadow mask stretching apparatus 3 shown in FIG. 3.

With these steps, a tension force (in arrow direction "a") is applied to the shadow mask 1, and a compression force (in arrow direction "b") is applied to the mask frame 2.

FIG. 2(*b*) illustrates a welding step. In this step, the upper surface of the long frame supports 2*a* and 2*b* of the mask frame 2 is fixed to the shadow mask 1 by welding.

A roller-type resistance welder 6 is used for welding. This is shown in more detail in FIGS. 3 and 6. The roller-type resistance welder 6 comprises a pressing means 7 and a roller electrode 10. Pneumatic pressure, hydraulic pressure or spring pressure can be used for the application of pressure with the pressing means 7. The pressing means 7 shown in FIG. 3 is an air cylinder, and a shaft 8 is expanded and contracted from this air cylinder. The roller electrode 10 moves up and down due to the expansion and contraction of the shaft 8. In this way, as is explained in more detail in the following, the roller electrode 10 can apply a constant pressure to the shadow mask 1. The movement of a roller electrode 10 along the long frame supports 2*a* and 2*b* is carried out by a horizontal movement of an arm portion 9*a* of a robot 9 for moving the welding head, as shown in FIG. 3.

Figure 4A:
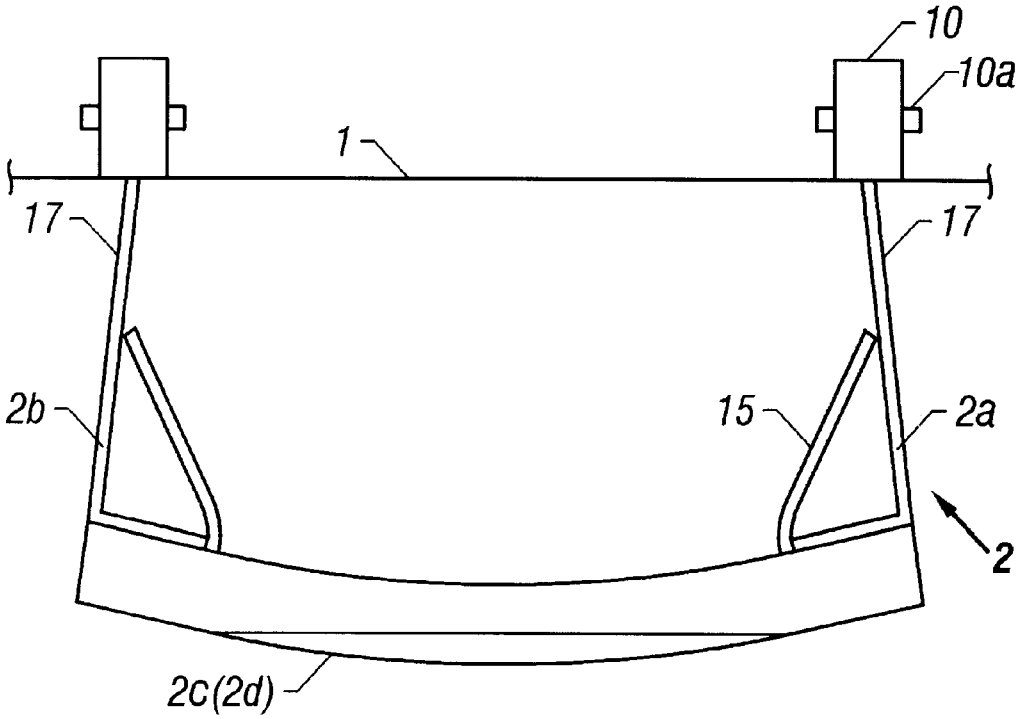
FIG. 4(*a*) shows a side view of a mask frame during a welding step according to the present invention.
Figure 4B:
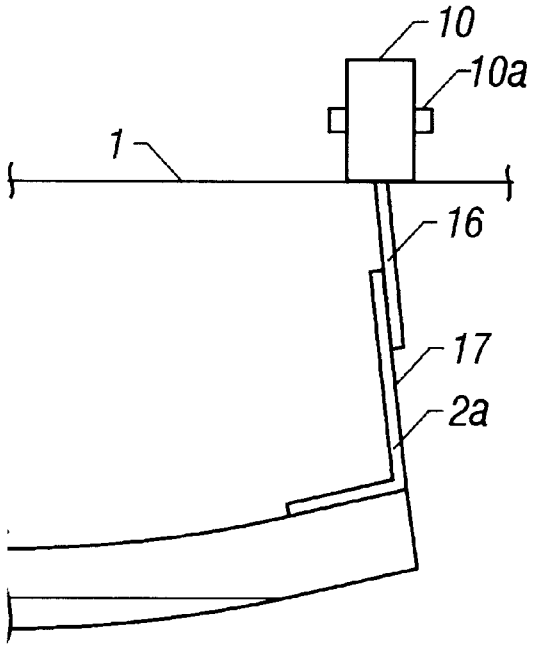

FIG. 4(*a*) shows a side view seen in longitudinal direction of the short frame supports 2*c* and 2*d* of the mask frame 2 during the welding step. Since the compression force in the mask frame pressing step keeps being applied continuously to the long frame supports 2*a* and 2*b*, an upright portion 17 of the long frame supports 2*a* and 2*b* tilts inward, and the short frame supports 2*c* and 2*d* warp concavely.

Figure 5A:
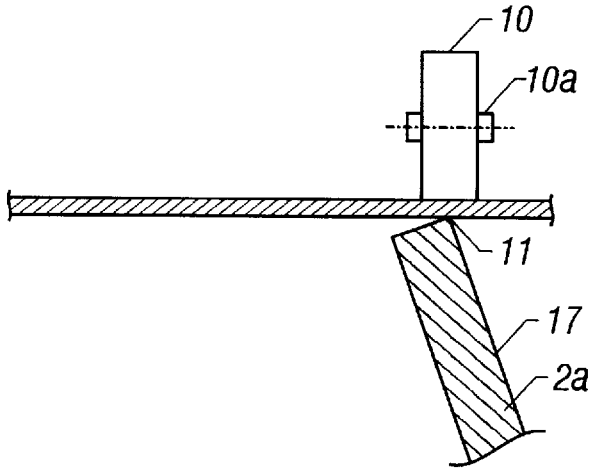
FIGS. 5(*a*) to (*c*) show cross portions illustrating roller electrode portions in a welding step according to the present invention.
Figure 5B:
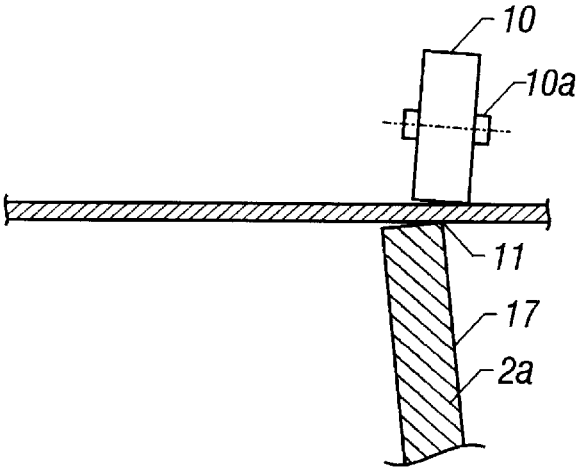
Figure 5C:
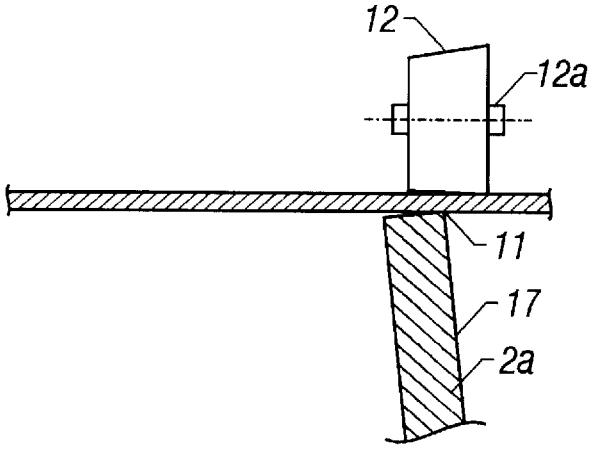

FIG. 5(*a*) is an enlarged cross section of a portion including the roller electrode 10 in this situation. As is shown in this drawing, due to the tilting of the upright portion 17 of the long frame support 2*a*, the shadow mask 1 contacts only an edge 11 of the upright portion 17, and is not in a real contact Furthermore, since the pressing means 7 applies a force to the roller electrode 10 in the direction in which the shadow mask 1 is pressed, the edge 11 and the roller surface serving as an electrode surface are in contact against each other via the shadow mask 1.

FIG. 5(*b*) shows an embodiment of the case in which a rotation axis 10*a* of the roller electrode 10 is tilted. When the rotation axis 10*a* is tilted like this, the edge 11 and the roller surface are reliably in contact against each other via the shadow mask 1 in both cases of slight and no tilting of the upright portion 17 of the long frame supports 2*a* and 2*b*. The roller electrode 12 shown in FIG. 5(*c*) has a conic trapezoidal shape. The conic trapezoidal shape of the roller surface means that the roller has an inclined surface, so even when the rotation axis 12*a* is horizontal, the edge 11 and the roller surface are reliably in contact against each other via the shadow mask 1 in both cases of slight and no tilting of an upright portion 17 of long frame supports 2*a* and 2*b*.

In all cases shown in FIG. 5(*a*) to (*c*), with the edge 11 and the roller surface contacting each other via the shadow mask 1, the shadow mask 1 is welded to the long frame supports 2*a* and 2*b* as the roller electrode rolls over the shadow mask.

Figure 6:
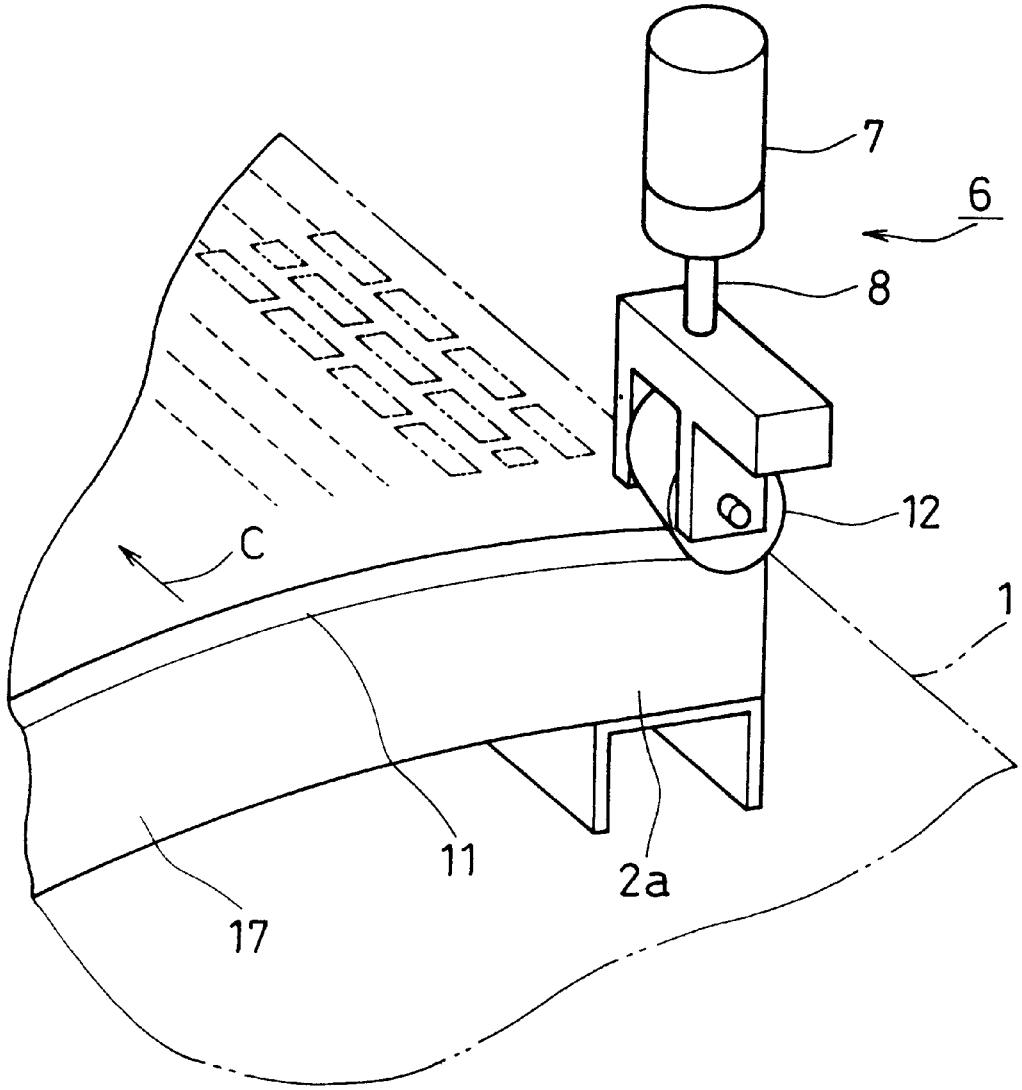
FIG. 6 shows an enlarged perspective view illustrating a roller electrode portion in a welding step according to the present invention.

FIG. 6 shows an enlarged perspective view illustrating the vicinity of the roller electrode. The roller electrode 12 shown in FIG. 6 is the conic trapezoidal roller shown in FIG. 5(*c*). This drawing shows the side of the long frame support 2*a*, but the following explanation is also true for the side of the long frame support 2*b*. Since the compression force in the mask frame pressing step is being applied continuously to the long frame support 2*a*, the long frame support 2*a* bends inward (in arrow direction "c".) Also, as has been explained with FIG. 5, the roller surface of the roller electrode 12 and the edge 11 contact each other via the shadow mask 1. In this drawing, the portion of the shadow mask 1 near the long frame support 2*a* has been omitted.

Since the long frame support 2*a* bends in arrow direction "c", the edge 11 looks like a flexure curve when seen from above. Welding with the roller electrode 12 is conducted along the edge 11. With this type of welding, the long frame support 2*a* is welded from the start point to the end point without deviating from the edge 11 on the upper surface of the upright portion 17.

The following is a detailed description of this welding along the edge 11. The roller electrode 12 can be moved in the forward direction by a horizontal movement of the arm portion 9*a* of the robot 9 for moving the welding head shown in FIG. 3. In this way, the shadow mask 1 and the long frame support 2*a* are welded to each other as the roller electrode 12 rolls along the long frame support 2*a*.

The edge 11 becomes a flexure curve as is described above, but the roller electrode 12 moves only in the horizontal direction. Therefore, misalignments between the position of the roller surface and the edge 11 are caused by the flexure curve of the edge 11.

However, despite the misalignments between the position of the roller surface and the edge 11, the roller electrode 12 and the edge 11 are still in contact against each other via the shadow mask 1. Therefore, the roller electrode 12 rolls along the edge 11 while the contact position of the roller surface and the edge 11 shifts. Accordingly, the long frame support 2*a* is welded from the start point to the end point without deviating from the edge 11 on the upper surface of the upright portion 17.

To contact the edge 11 continually against the roller electrode 12 via the shadow mask 1, an arrangement is preferable where the pressure load on the mask frame 1 caused by, for example, the roller electrode 12 is constant. Such an arrangement is possible by the expansion and contraction of the shaft 8 by the pressing means 7. In this case, the pressure load due to the roller electrode 12 is detected, and the shaft is expanded or contracted so as to make the pressure load constant.

Figure 7A:
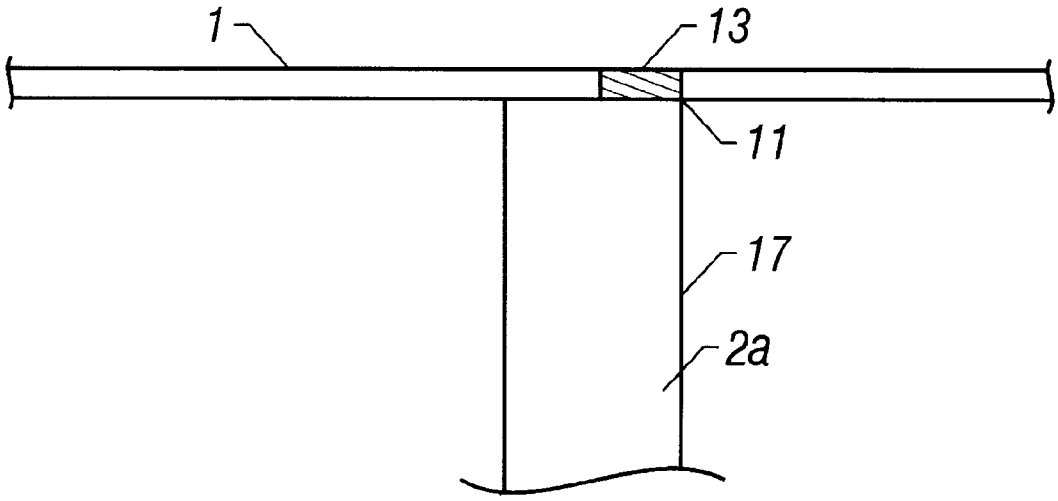
FIGS. 7(*a*) and (*b*) show side views illustrating upright portions of a mask frame after welding according to the present invention.
Figure 7B:
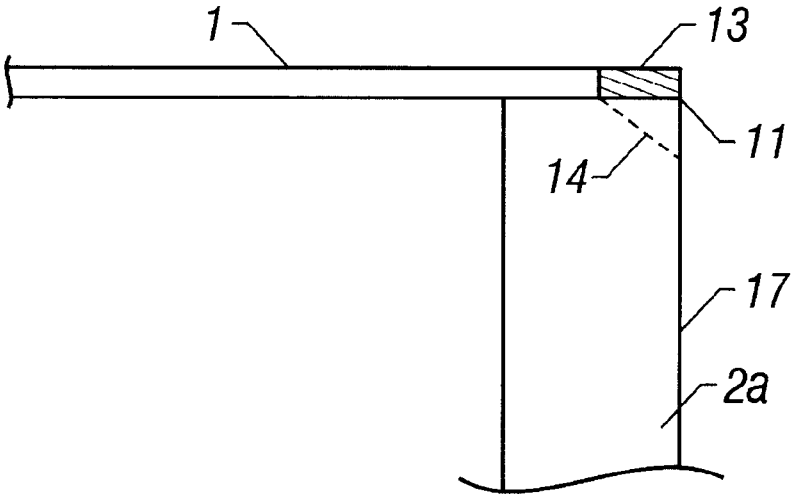

Thus, with such a welding method, complex control devices for letting the welding position follow the flexure curve of the upright portion 17 by using a separate position detection means and driving unit are not necessary. Smooth and reliable welding at a predetermined position is made possible by a simple structure. FIGS. 7 (*a*) and (*b*) are side views illustrating the upright portions 17 of long frame supports after the welding. FIG. 7(*a*) shows the situation immediately after the welding, and FIG. 7(*b*) shows the situation where an unwanted part of a shadow mask 1 is cut off in the following cutting step. As is shown in FIGS. 7(*a*) and (*b*), a weld nugget 13 will be formed only in the outer edge portion of the upper surface of the upright portion 17.

Since a compression force is applied to the shadow mask 1, the long frame support 2*a* is fixed while slightly tilting inward, but the inclination of the upper surface of the frame is not large enough to change the q-value.

Therefore, when a shadow mask is torn off in case of a defect, the weld nugget will remain only in the outer edge portion of the upper surface of the upright portion 17. Accordingly, if the upright portion 17 is removed to the position indicated with a double-dashed line 14 in FIG. 7(*b*), in other words, if only the edge portion 11 of the upright portion 17 is removed, the weld nugget 13 can be removed as well, and a flat surface will still remain on the upper surface of the upright portion 17.

Also, if the weld nugget is formed in the portion within half a width of the upper surface of the upright portion 17 from the outer edge of the upright portion 17, enough flat surface remains on the upper surface of the upright portion 17 to weld at least one more time. Thus, the shadow mask can be torn off and welded again at least once after the first welding. In other words, the shadow mask can be reused at least once, thereby saving resources.

If, for example, the width of the weld nugget is ⅓ of the width of the upper edge surface of the mask frame, a flat surface remains for welding the upper surface of the mask frame at least twice. Therefore, the mask frame can be reused twice. Adjustment of the welding width described above is possible by adjusting the current of the resistance welder and the rotating speed of the roller.

After the completion of welding, the tension force applied to the shadow mask 1 and the compression force applied to the mask frame 2 are cancelled. At this moment, the force contracting the shadow mask 1 and the force stretching the mask frame become balanced. In this state of balance, the shadow mask 1 is fixed to the mask frame 2 with a tension force acting on the shadow mask 1.

FIG. 2(*c*) shows the situation where an unwanted part of the shadow mask 1, beyond the outer edge of the mask frame 2, has been cut off after the completion of welding. By going through the steps explained above, the stretching of the shadow mask is now complete.

The above explanations related to a one-dimensional tension system in which a tension force is applied only to the vertical direction. However, the same effect can be achieved in a two-dimensional tension system, in which a tension force is applied to both the vertical and the horizontal direction, when, in addition to the long frame supports, also the short frame supports are welded with the method of this embodiment.

Also, the long frame support of the mask frame illustrated in this embodiment is formed by bending one plate member into an L-shape. However, another plate member 16 may be fixed, for example by welding it to a surface of the upright portion 17, as shown in FIG. 4(*b*). In this case, a shadow mask 1 is welded to the additional plate member. Accordingly, when a material with low expansion coefficient is used for the shadow mask, an inexpensive material with a high expansion coefficient, such as steel, can be used for a mask frame body, and a material with a lower expansion coefficient, that is about the same as the one used for the shadow mask, can be used for the plate member fixed to the mask frame body, thereby cutting costs.

In addition, this embodiment has been explained for an L-shaped cross section of the mask frame, but it is also possible to add an oblique side for additional strength, as indicated by the double-dashed line 15 in FIG. 4(*a*).

Moreover, this embodiment has been explained for a shadow mask that is fixed to a curved mask frame, but it is also possible to fix the mask frame to a flat mask frame.

Also, this embodiment has been explained and illustrated for a slot-type shadow mask, but it is also possible to use a dot-type or an aperture grille-type.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for manufacturing a color cathode ray tube comprising:

welding a shadow mask to a frame-shaped mask frame while applying a compression force to the mask frame in a direction that decreases a distance between at least one pair of opposite sides of the mask frame, and applying a tension force to the shadow mask, wherein said welding is performed by rolling a roller electrode of a roller-type resistance welder with a rotation axis of the roller electrode tilted while contacting an electrode surface of the roller electrode against an outer edge of the mask frame via the shadow mask.

2. A method for manufacturing a color cathode ray tube comprising:

welding a shadow mask to a frame-shaped mask frame while applying a compression force to the mask frame in a direction that decreases a distance between at least one pair of opposite sides of the mask frame, and applying a tension force to the shadow mask, wherein said welding is performed by rolling a roller electrode of a roller-type resistance welder while contacting an electrode surface of the roller electrode against an outer edge of the mask frame via the shadow mask, and the roller electrode has a conic trapezoidal shape with an inclined electrode surface.

3. A method for manufacturing a color cathode ray tube comprising:

welding a shadow mask to a frame-shaped mask frame while applying a compression force to the mask frame in a direction that decreases a distance between at least one pair of opposite sides of the mask frame, and applying a tension force to the shadow mask, wherein said welding is performed by rolling a roller electrode of a roller-type resistance welder while a pressure means presses the roller electrode with a constant pressure against the shadow mask, and a contact position between an electrode surface of the roller electrode and an outer edge of the mask frame is shifted by a flexure curve of the outer edge of the mask frame under a condition of contacting the electrode surface of the roller electrode against the outer edge of the mask frame via the shadow mask.

4. A method for manufacturing a color cathode ray tube comprising:

welding a shadow mask to a frame-shaped mask frame while applying a compression force to the mask frame in a direction that decreases a distance between at least one pair of opposite sides of the mask frame, and applying a tension force to the shadow mask, wherein said welding is performed by rolling a roller electrode of a roller-type resistance welder while contacting an electrode surface of the roller electrode against an outer edge of the mask frame via the shadow mask, a weld nugget formed by said welding is formed at a side adjacent to an outer edge of an upper surface of the mask frame, and a surface on which no nugget is formed remains on a side opposite to the outer edge, and the weld nugget is formed within an outer ⅓ to ½ of a width of the upper surface of the mask frame.

5. A method for manufacturing a color cathode ray tube comprising:

welding a shadow mask to a frame-shaped mask frame while applying a compression force to the mask frame in a direction that decreases a distance between at least one pair of opposite sides of the mask frame, and applying a tension force to the shadow mask, wherein the mask frame comprises a frame-shaped mask frame body, and a plate member fixed along a side of the mask frame body such that a height direction of at least one side of the mask frame body is increased, the shadow mask is welded to the plate member, and said welding is performed by rolling a roller electrode of a roller-tape resistance welder while contacting an electrode surface of the roller electrode against an outer edge of the mask frame via the shadow mask.

* * * * *

US006139387C1

(12) EX PARTE REEXAMINATION CERTIFICATE (5332nd)

United States Patent

Kimura et al.

(10) Number: US 6,139,387 C1

(45) Certificate Issued: Apr. 11, 2006

(54) METHOD FOR MANUFACTURING A COLOR CATHODE RAY TUBE

(75) Inventors: Masamichi Kimura, Takatsuki (JP); Tsutomu Utsumi, Kyoto (JP); Takashi Kinoshita, Takatsuki (JP)

(73) Assignee: Matsushita Electric Industrial Co., Ltd., Kadoma (JP)

Reexamination Request:
No. 90/006,521, Jan. 22, 2003

Reexamination Certificate for:

| | |
|---|---|
| Patent No.: | **6,139,387** |
| Issued: | **Oct. 31, 2000** |
| Appl. No.: | **09/379,654** |
| Filed: | **Aug. 24, 1999** |

(30) Foreign Application Priority Data

Aug. 26, 1998 (JP) ..... 10-240149

(51) Int. Cl.
*H01J 9/18* (2006.01)

(52) U.S. Cl. ..... 445/30; 445/36; 445/37; 445/68; 445/69

(58) Field of Classification Search ..... 445/36, 445/37, 67, 68
See application file for complete search history.

(56) References Cited

FOREIGN PATENT DOCUMENTS

| | | |
|---|---|---|
| JP | 9-147759 | 6/1997 |
| JP | 10-21842 | 1/1998 |

OTHER PUBLICATIONS

Full Translation of JP 9 (1997)–147759 A, 22 pgs.
Full Translation of JP 10 (1998)–21842 A, 18 pgs.
Verification of Translations, 1 pg.

*Primary Examiner*—Mariceli Santiago

(57) ABSTRACT

Welding is conducted by rolling a roller electrode of a roller-type resistance welder while contacting an electrode surface of the roller electrode against an outer edge of the mask frame via the shadow mask. This method eliminates the need for complex control, and allows smooth and reliable welding at predetermined positions with a simple configuration. By forming the weld nugget on the side of the edge, a flat portion remains when the shadow mask is torn off the mask frame in case of a failure of the shadow mask. Thus, a second welding with a flat portion of the original height is possible, and the mask frame can be reused with the same precision for the welding position.

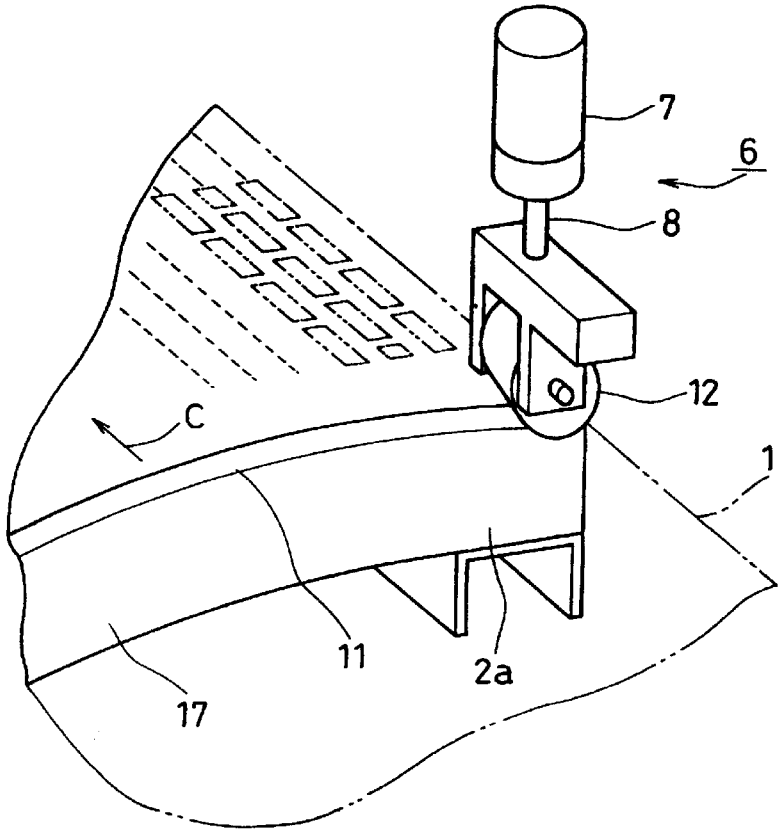

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2 and 4 is confirmed.

Claims 1, 3 and 5 are determined to be patentable as amended.

1. A method for manufacturing a color cathode ray tube comprising:

welding a shadow mask to a frame-shaped mask frame while applying a compression force to the mask frame in a *first axis* direction that decreases a distance between at least one pair of opposite sides of the mask frame, and applying a tension force to the shadow mask *in at least the first axis direction*, wherein said welding is performed *by shifting a contact position between an electrode surface of a roller electrode and an outer edge of the mask frame by a flexure curve of the outer edge of the mask frame, by moving the roller electrode in a straight line in a second axis direction perpendicular to the first axis direction, and* by rolling [a] *the* roller electrode of a roller-type resistance welder with a rotation axis of the roller electrode tilted while contacting [an] *the* electrode surface of the roller electrode against an outer edge of the mask frame via the shadow mask.

3. A method for manufacturing a color cathode ray tube comprising:

welding a shadow mask to a frame-shaped mask frame while applying a compression force to the mask frame in a *first axis* direction that decreases a distance between at least one pair of opposite sides of the mask frame, and applying a tension force to the shadow mask *in at least the first axis direction*, wherein said welding is performed by rolling a roller electrode of a roller-type resistance welder while a pressure means presses the roller electrode with a constant pressure against the shadow mask, and a contact position between an electrode surface of the roller electrode and an outer edge of the mask frame is shifted by a flexure curve of the outer edge of the mask frame*, by moving the roller electrode in a straight line in a second axis direction perpendicular to the first axis direction,* under a condition of contacting the electrode surface of the roller electrode against the outer edge of the mask frame via the shadow mask.

5. A method for manufacturing a color cathode ray tube comprising:

welding a shadow mask to a frame-shaped mask frame while applying a compression force to the mask frame in a *first axis* direction that decreases a distance between at least one pair of opposite sides of the mask frame, and applying a tension force to the shadow mask *in at least the first axis direction*, wherein the mask frame comprises a frame-shaped mask frame body, and a plate member fixed along a side of the mask frame body such that a height direction of at least one side of the mask frame body is increased, the shadow mask is welded to the plate member, and said welding is performed *by shifting a contact position between an electrode surface of a roller electrode and an outer edge of the mask frame by a flexure curve of the outer edge of the mask frame, by moving the roller electrode in a straight line in a second axis direction perpendicular to the first axis direction, and* by rolling [a] *the* roller electrode of a [roller-tape] *roller-type* resistance welder while contacting [an] *the* electrode surface of the roller electrode against an outer edge of the mask frame via the shadow mask.

* * * * *